United States Patent [19]

Andreini et al.

[11] 4,436,553

[45] Mar. 13, 1984

[54] PROCESS TO PRODUCE LOW HYDROGEN STEEL

[75] Inventors: Rockne J. Andreini, Bellevue, Wash.; Stewart K. Mehlman, Tarrytown, N.Y.; Ronald J. Selines, Yorktown Heights, N.Y.; Balkishan Agrawal, Ossining, N.Y.

[73] Assignee: Union Carbide Corporation, Danbury, Conn.

[21] Appl. No.: 341,440

[22] Filed: Jan. 22, 1982 (Under 37 CFR 1.47)

[51] Int. Cl.[3] ..... C21C 7/00

[52] U.S. Cl. ..... 75/52; 75/59; 75/60

[58] Field of Search ..... 75/52, 60, 59

[56] References Cited

U.S. PATENT DOCUMENTS

| | | | |
|---|---|---|---|
| Re. 29,584 | 3/1978 | Heise | 75/60 |
| 3,046,107 | 7/1962 | Nelson | 75/59 |
| 3,252,790 | 5/1966 | Krivsky | 75/59 |
| 3,754,894 | 8/1973 | Saccomano | 75/59 |
| 3,816,720 | 6/1974 | Bauer | 75/60 |
| 3,854,932 | 12/1974 | Bishop | 75/60 |
| 4,187,102 | 2/1980 | Choulet | 75/60 |
| 4,208,206 | 6/1980 | Death | 75/60 |
| 4,278,464 | 7/1981 | Bury | 75/52 |

*Primary Examiner*—Peter D. Rosenberg

*Attorney, Agent, or Firm*—Stanley Ktorides; Lawrence G. Kastriner

[57] ABSTRACT

Steel is produced by the argon-oxygen decarburization process which has a low hydrogen content, generally below 2 ppm.

10 Claims, No Drawings

PROCESS TO PRODUCE LOW HYDROGEN STEEL

TECHNICAL FIELD

This invention relates generally to the production of steel, and specifically to the production of steel by use of the argon-oxygen decarburization (AOD) process.

BACKGROUND ART

It is generally undesirable for steel to have high hydrogen content. Steel having a high hydrogen content is normally characterized by a reduction in its ductility and toughness as compared to low hydrogen content steels. In heavy steel sections, an excessively high hydrogen content may result in the formation of internal cracks during cooling. Such internal cracks are normally referred to in the steelmaking art as flakes, fissures, fisheyes or hairline cracks.

One method known to the steelmaking art for removing hydrogen from a steel melt is vacuum degassing. This method however, requires expensive and hard to maintain equipment, and also requires either a supplementary heat source or a high melt temperature to compensate for heat loss during the vaccumm processing.

The AOD process has achieved wide acceptance in the steel industry due to its ability to decarburize refine the melt, increase productivity, as well as to provide pinpoint temperature and chemistry control for steel melt. While the AOD process will under standard operating practices produce steels having a hydrogen content that is acceptable for most applications, it is not low enough for steel intended to be forged into large sections, such as forgings intended for ship drive shafts and other large section forgings. It is therefore desirable to produce steel for certain applications that has a very low hydrogen content by means of the AOD process.

The AOD process is well known in the art. The basic AOD refining process is disclosed by Krivsky in U.S. Pat. No. 3,252,790. An improvement of Krivsky relating to the programmed blowing of the gases is disclosed by Nelson et al in U.S. Pat. No. 3,046,107. The use of nitrogen in combination with argon and oxygen to achieve predetermined nitrogen contents is disclosed by Saccomano et al in U.S. Pat. No. 3,754,894. An improved AOD Process incorporating a computer program is disclosed in U.S. Pat No. 3,816,720. A modification of the AOD process is also shown by Johnson et al in U.S. Pat. No. 3,867,135 which utilizes steam or ammonia in combination with oxygen to refine molten metal. U.S. Pat. No. Re. 29,584 discloses an AOD Process wherein the decarburization rate is increased without increasing refractory wear. Choulet and Mehlman disclose in U.S. Pat. No. 4,187,102 a method to control the temperature of a steel melt refined by subsurface pneumatic refining, such as the AOD process. A method for controlling slopping during subsurface pneumatic refining of steel, such as by the AOD process is disclosed by Bury et al in U.S. Pat. No. 4,278,464.

It is therefore an object of this invention to provide an improved AOD Process capable of producing steel having a low hydrogen content.

DISCLOSURE OF THE INVENTION

The above and other objects which will become apparent to those skilled in the art from this disclosure are achieved by the present invention, which comprises:

in a process for the production of steel comprising: charging a steel melt into a refining vessel equipped with at least one submerged tuyere, making alloying and slag-forming additions to the melt, decarburizing the melt by injecting into the melt through said tuyere(s) a gas mixture comprising oxygen and a dilution gas, the decarburization being followed by at least one reduction or finishing step characterized by the injection of a sparging gas into the melt through said tuyere(s), said tuyere(s) being gas-cooled during at least a portion of the production process, the improvement, whereby steel having a low hydrogen content is produced, comprising, in combination:

(A) providing an essentially dry refining vessel into which the melt is charged;

(B) providing essentially dry cooling gas to the tuyere(s);

(C) completing essentially all of the slag-forming additions to the melt prior to start of the decarburization;

(D) fluxing the slag-forming additions prior to start of the decarburization;

(E) completing substantially all difficult to oxidize alloying additions to the melt prior to start of the decarburization;

(F) decarburizing the melt to essentially its aim carbon content by injecting into the melt through said tuyere(s), a gas mixture of oxygen and dilution gas for a time sufficient to remove at least about 0.2 weight percent carbon from the melt at a flow rate sufficient to generate off-gas flow sufficient to keep air from infiltrating into the vessel; and (G) maintaining said off-gas flow during the reduction and/or finishing step(s) by injecting at a sufficient rate sparging gas into the melt through said tuyere(s), in an amount at least equal to 100 cubic feet per ton of melt.

DETAILED DESCRIPTION

The term, "argon-oxygen decarburization (AOD) process" is used herein to mean a process for refining molten metal contained in a refining vessel which is provided with at least one submerged tuyere comprising (a) injecting into the melt through said tuyere(s) a gas mixture containing oxygen and a dilution gas, wherein said dilution gas functions to reduce the partial pressure of the carbon monoxide in the gas bubbles formed during decarburization of the melt and/or to alter the feed rate of oxygen to the melt without substantially altering the total injected gas flow rate and thereafter (b) injecting a sparging gas into the melt through said tuyere(s) wherein said sparging gas functions to remove impurities by degassing, deoxidation, volatilization or by flotation of said impurities with subsequent entrapment or reaction with the slag. The process is normally carried out by having the oxygen-containing gas stream surrounded by an annular stream of protective fluid which functions to protect the tuyere(s) and the surrounding refractory lining from excessive wear. Useful dilution gases include argon, helium and nitrogen. Nitrogen is preferred, unless low nitrogen containing steel is the desired product, in which case argon is preferred. Useful sparging gases include argon, helium, and nitrogen; nitrogen or argon being preferred. Useful protective fluids include argon, helium, nitrogen, carbon monoxide and carbon dioxide; nitrogen or argon being preferred. As is known, the broad AOD Process may use hydrogen, steam or a hydrocarbon fluid as one or more of the dilution gas, sparging gas or protective fluid. However, when low hydrogen steel is the desired product, such hydrogen containing fluids are not useful in the AOD Process.

The term, "submerged tuyere", as used in the present specification and claims is intended to mean an apparatus which will allow the injection of gases into a steel melt from beneath the surface of the melt.

The term, "reduction step", as used in the present specification and claims is intended to mean the recovery of metals oxidized during decarburization by the addition to the melt of a reducing agent such as silicon or a silicon containing ferroalloy or aluminum followed by sparging the melt to complete the reduction reaction.

The term, "finishing step", as used in the present specification claims is intended to mean final adjustments in the melt chemistry by addition to the melt of required material followed by sparging the melt to assure uniform composition.

The term, "fluxing", as used in the present specification and claims is intended to mean substantially dissolving the slag-forming additions in the melt.

The term, "easily oxidized alloying addition", as used in the present specification and claims is intended to mean elements not reducible by silicon addition to a steel melt.

The term, "difficult to oxidize alloying addition", as used in the present specification and claims is intended to mean elements reducible by silicon addition to a steel melt.

The term "off-gases" is used in the specification and claim is intended to mean the gases which come off a steel melt during decarburization, reduction or finishing.

This invention is an improvement on the AOD proces which permits the process to be used to produce steel having a low hydrogen content. The invention resides in the discovery that certain steps are necessary for the production of low hydrogen AOD refined steel, and that all of those steps are necessary for the process to produce the desired result.

The term, low hydrogen steel, generally refers to steel having a hydrogen content of less than 2 ppm. However strict adherence to such a quantity is impractical because of difficulties in sampling associated with the steelmaking art. These difficulties, with the resulting inaccuracies of sample analysis, include the loss of hydrogen as the sample is transported from the refining vessel to the analytical instrument and the general lack of confidence that any given sample is genuinely representative of the melt because of the lack of chemical uniformity of the melt in the refining vessel.

There now follows a detailed description of the improved process of this invention. A steel melt is charged to a refining vessel the inside of which is dry. If the refining vessel has just previously been used to refine a steel melt no drying action is generally required by operating personnel since the refining vessel will generally be sufficiently dry. If the refining vessel has not been just previously employed to refine steel, the vessel may be dried by any suitable drying action such as to apply a torch flame to the refining vessel's inner surface. One method of insuring that the refining vessel is dry for purposes of the present invention is to provide a refining vessel with an inner surface temperature of at least 1500° F., preferably at least 1800° F.

In the practice of this invention the tuyere(s) are gas-cooled during at least a portion of the production process and preferably during all of the production process. While oxygen is injected through the tuyere(s), they are cooled generally by the protective fluid. During the reduction or finishing step(s) the tuyere(s) are cooled generally by the sparging gas which may also serve as the protective fluid. While the refining vessel is tilted, in order to pour out the refined melt, tuyere(s) which are above the melt surface are cooled generally by a stream of air which passes through the tuyere. This air stream is usually from a compressor. If the cooling is done by a gas other than air, such as when the tuyere(s) are still beneath the melt surface even though the vessel is tilted, the cooling gas is generally provided from a cryogenic tank and is generally of sufficient dryness such that no further drying action is required by the operating personnel. If the cooling gas is air there will generally be required a drying step before the air is employed. This drying step may be conveniently accomplished by passing the compressed air through a dryer before it is introduced to the tuyere(s). Preferably, the cooling gas contains less than 100 PPM by weight of water.

In the practice of this invention, essentially all of the slag-forming additions to the melt are made prior to the start of decarburization. Slag-forming additions are generally lime or mixtures of lime and magnesite but may be any material which serves to form an effective slag. The slag is employed to neutralize oxides thereby enabling desulfurization of the melt to take place and to lessen the amounts of oxygen, nitrogen and hydrogen introduced into the melt by contact with air.

It is of great importance to the successful practice of this invention that the slag-forming additions be fluxed prior to the start of the decarburization. This is because the slag-forming additions generally unavoidably add to the melt a considerable amount of hydrogen usually in the form of water. Unless essentially all of the slag-forming additions are added to the melt and fluxed prior to decarburization so that the hydrogen will be subject to removal from the melt during the entire decarburization and subsequent reduction or finishing step(s), sufficient hydrogen will remain in the melt so as to defeat the purpose of this invention.

In the production of steel it is usually necessary to make alloying additions to the steel melt which is charged to the refining vessel. Rarely will the chemical composition of the steel melt charged to the refining vessel be within the specifications of the desired product. The alloying additions are made in order to bring the melt within the desired or aim specification ranges. The addition of alloying material into the melt is a further source of hydrogen. It is therefore a part of the practice of this invention to make most and preferably all of the alloying additions to the melt prior to the start of the decarburization. By this practice, the hydrogen introduced into the melt by the alloying additions will be subject to removal during the entire decarburization and reduction or finishing step(s) resulting in maximum hydrogen removal.

However, alloying additions fall into two categories termed herein easily oxidized and difficult to oxidize. Difficult to oxidize alloying additions may form oxides in the melt during the decarburization step but can be reduced back to the elemental form during a subsequent reduction step. However, easily oxidized alloying additions, which will also form oxides in the melt during the decarburization step, will not be reduced by a reduction step. Therefore, easily oxidized alloying additions such as titanium, aluminum, and the like must be made subsequent to the decarburization step while substantially all of the difficult to oxidize alloying additions such as chromium, manganese, nickel, molybdenum, cobalt, copper and the like must be made prior to decarburization. As indicated previously the chemistry of the melt charged to the refining vessel and the chemistry of the desired product will determine which specific alloying additions are made, and also the quantity of each addition made, as is well known to those skilled in this art.

The melt is decarburized by injecting into the melt through the submerged tuyere(s) a gas mixture of oxygen and a dilution gas. The decarburization step is carried out in order to burn out some of the carbon in the melt to bring the melt within the specification of the desired product. The decarburization reaction is also exothermic and contributes some heat. In the decarburization reaction carbon in the melt reacts with the injected oxygen gas to form carbon monoxide gas which bubbles through the melt. The dilution gas serves to reduce the partial pressure of the carbon monoxide gas so as to reduce unwanted metallic oxidation. Further, the injected gas mixture helps carry out other impurities in the melt as it bubbles through the melt and emerges from the melt as off gas.

In the practice of this invention the decarburization step serves to remove a large quantity of any hydrogen which may be in the melt prior to decarburization. Furthermore, the decarburization step insures that little or no hydrogen from the atmosphere, such as from water vapor, is allowed to enter the melt during the decarburization by generating sufficient off-gases during the decarburization step so that the off-gas flow rate is sufficient to keep air from infiltrating the refining vessel. This is accomplished by injecting the oxygen-dilution gas mixture for a sufficient time to remove at least 0.2 weight percent of carbon from the melt, perferably at least 0.3 weight percent, at an injection rate such that sufficient off-gas is generated to keep air from infiltrating the refining vessel. The gas mixture injection rate will vary depending on the configuration of the refining vessel, the amount of draft created through the vessel's mouth, and other factors, such as operation of pollution equipment, known to those skilled in the art.

Should the melt not contain sufficient carbon to allow the required decarburization while still achieving the desired or aim carbon content, carbon may be added to the melt prior to or during decarburization in an amount such that sufficient carbon is burned out to achieve the aims of the process of this invention while also attaining the aim carbon content. Carbon should not be added to the melt after the decarburization step, i.e., the melt should not be decarburized substantially below its aim carbon content and then brought up to specification by large carbon additions, since this late carbon addition may introduce hydrogen into the melt so as to defeat the purpose of the process of this invention.

After the melt is decarburized it is reduced and/or finished by one or more reduction or finishing steps. A reduction step is one wherein a previously added alloying addition, which has, in part, oxidized, is reduced from the slag to the steel melt usually by the introduction of aluminum or silicon to the melt. A finishing step is one wherein any other addition necessary to bring the melt within the desired specifications is made. Such an addition may be a very small amount of difficult to oxidize alloying addition, or any other addition such as is well known to those in the steel-making art.

During the reduction and/or finishing step(s) it is necessary that air be kept from the melt so that hydrogen, such as from water vapor, not be allowed to enter the melt and defeat the purpose of the process of this invention. Air is kept from the melt during reduction and finishing by insuring that the off-gas flow rate is sufficient to keep air from infiltrating the refining vessel. This is done by injecting the sparging gas into the melt for such time as to allow at least 100 total cubic feet of sparging gas to be injected per ton of melt, preferably at least 150 total cubic feet per ton of melt at an injection rate such that sufficient off-gas is generated to keep air from infiltrating the refining vessel. The sparging gas injection rate will vary depending on the configuration of the refining vessel, the amount of draft created through the vessel's mouth, and other factors known to those skilled in the art.

The foregoing description of the process of this invention has described the essential AOD process and the steps which are required in combination to achieve low hydrogen steel. Those skilled in the art will recognize that there are further steps which one can conduct in the AOD method of steel production. When such further steps are conducted, they should be done in such a way as to minimize hydrogen introduction and retainment in the melt. For example, in the AOD practice, one might desire to add fuel such as silicon or aluminum to the melt. If this is done, fuel additions should preferably be made prior to decarburization to as great an extent as possible, consistent with good operating practice, without encountering slopping. This also aids in fluxing the slag-forming ingredients.

The following examples serve to further illustrate the invention or to illustrate the necessity of having all of the required improvement steps present, in combination, for the objects of this invention to be attained.

EXAMPLES 1–6

Six melts were refined in accordance with the process of this invention. The refining parameters and hydrogen concentration at various points in the refining process are shown in Table 1. Examples 1–5 were carried out in a 35 ton refining vessel having a cross-sectional area at the mouth of 6.3 square feet. Example 6 was carried out in a 100 ton refining vessel having a cross-sectional area at the mouth of 18.9 square feet. The off-gas flow rates are reported as actual cubic feet per minute (ACFM) per square feet of cross-sectional area at the vessel mouth assuming an off-gas temperature of 3000° F.

TABLE 1

| EX | H CONC. AT CHARGE (ppm) | OFF GAS FLOW RATE DURING DECARB ($ACFM/FT^2$) | WEIGHT PERCENT CARBON REMOVED BY DECARB | H CONC. AFTER DECARB (ppm) | OFF-GAS FLOW RATE DURING REDUCTION AND FINISHING ($ACFM/FT^2$) | TOTAL SPARGING GAS ($FT^3/TON$) | H CONC. AT TAP (ppm) |
|---|---|---|---|---|---|---|---|
| 1 | 4 | 2150 | 0.44 | N.A. | 1160 | 383 | 1.2 |
| 2 | 4 | 2150 | 0.72 | N.A. | 1160 | 196 | 1.7 |
| 3 | 4 | 2150 | 0.19 | 1.5 | 1160 | 146 | 1.3 |
| 4 | 4 | 2150 | 1.49 | 1.5 | 1060 | 255 | 0.9 |

TABLE 1-continued

| EX | H CONC. AT CHARGE (ppm) | OFF GAS FLOW RATE DURING DECARB (ACFM/FT$^2$) | WEIGHT PERCENT CARBON REMOVED BY DECARB | H CONC. AFTER DECARB (ppm) | OFF-GAS FLOW RATE DURING REDUCTION AND FINISHING (ACFM/FT$^2$) | TOTAL SPARGING GAS (FT$^3$/TON) | H CONC. AT TAP (ppm) |
|---|---|---|---|---|---|---|---|
| 5 | 4 | 2150 | 0.38 | 1.3 | 985 | 194 | 0.8 |
| 6 | 5.5 | 1600 | 0.70 | 1.1 | 880 | 130+ | 1.4 |

The hydrogen concentration at charge for Examples 1–5 was estimated. The hydrogen concentration after decarburization for Examples 1 and 2 was not available. The total sparging gas injected in Example 6 was greater than 130 cubic feet per ton of melt.

These Examples 1–6 clearly demonstrate that the process of this invention will produce steel having a low hydrogen content.

EXAMPLES 7, 8

Examples 7 and 8 demonstrate the necessity of providing a dry refining vessel for the melt. Both Examples 7 and 8 were carried out in the refining vessel used to carry out Example 6. In Example 7, the melt was refined in a refining vessel which had not been dried. In this example the inside of the refining vessel had been under flame for only about 4 hours which was not sufficient time to allow the vessel's inner surface to attain a temperature sufficient to insure a dry vessel. Example 8 followed immediately after Example 7 and thus the refining vessel was of a sufficient temperature to be dry. All of the other refining parameters were in accord with the requirements of the process of this invention for both Examples 7 and 8. The results are shown in Table 2.

TABLE 2

| EXAMPLE | H CONC. AT CHARGE (ppm) | H CONC. AFTER DECARB (ppm) | H CONC. AT TAP (ppm) |
|---|---|---|---|
| 7 | 2.9 | 1.2 | 2.8 |
| 8 | 3.2 | 1.3 | 1.6 |

Although low hydrogen was achieved for both melts after decarburization, as the refining process progressed the moisture in the refining vessel inner surface was gradually transferred to the melt. In Example 7 which began with a vessel which was not of sufficient dryness this moisture transfer resulted in a melt with an unacceptably high hydrogen content.

EXAMPLES 9–11

Examples 9–11 demonstrate the importance of the addition of essentially all the slag-forming additions prior to the start of decarburization. Each of Examples 9–11 were carried out in the refining vessel used to carry out Examples 1–5. In each of Examples 9–11, 4–8 pounds of lime per ton of melt were added to the melt after decarburization. The hydrogen concentration of each melt at charge was estimated and the hydrogen concentration of the melt in Example 11 was not available. All of the other refining parameters were in accord with the requirements of the process of this invention for each of Examples 9–11. The results shown in Table 3 demonstrate that addition of 4–8 pounds per ton of melt of slag-forming additions after decarburization results in steel having an unacceptably high hydrogen content.

TABLE 3

| EXAMPLE | H. CONC. AT CHARGE (PPM) | H CONC. AFTER DECARB (PPM) | H CONC. AT TAP (PPM) |
|---|---|---|---|
| 9 | 4 | 1.5 | 2.1 |
| 10 | 4 | 1.1 | 2.1 |
| 11 | 4 | N.A. | 2.4 |

EXAMPLE 12

Example 12 demonstrates the necessity that the slag-forming aditions be fluxed prior to decarburization. Example 12 was carried out in the refining vessel used to carry out Example 6. In this example lime was added to the melt prior to decarburization but was not completely fluxed prior to the start of decarburization. All of the other refining parameters were in accord with the requirements of the process of this invention. The hydrogen concentration of the charged melt was 4.6 ppm, after decarburization it was 2.3 ppm and at tap it was 2.0 ppm. Thus low hydrogen steel was not produced.

EXAMPLES 13–19

Examples 13–19 demonstrate the necessity of sufficient sparging gas injection during the reduction and/or finishing step(s). Each of Examples 13–19 were carried out in the refining vessel used to carry out Examples 1–5. In these examples argon was employed as the sparging gas. In Table 4, the first column lists the total argon injected as the sparging gas during the reduction or finishing steps and the second column lists the increase or decrease of the hydrogen concentration of the melt from the end of the decarburization to the time the melt was poured out of the refining vessel, i.e., during the reduction and/or finishing step(s). All of the other refining parameters were in accord with the requirements of the process of this invention. The results demonstrate that at less than a total of about 100 cubic feet of sparging gas injected per ton of melt the hydrogen concentration of the melt will increase during the reduction and finishing steps.

TABLE 4

| Example | Sparging Gas Injection (FT3/TON) | Charge in H Conc. from decarb to tap (PPM) |
|---|---|---|
| 13 | 33 | +1.0 |
| 14 | 90 | +0.8 |
| 15 | 95 | +0.1 |
| 16 | 146 | −0.2 |
| 17 | 194 | −0.4 |
| 18 | 255 | −0.3 |
| 19 | 836 | −0.3 |

We claim:

1. A process for the production of steel having a hydrogen content of less than about 2 ppm, comprising:

charging a steel melt into a refining vessel equipped with at least one submerged tuyere, making alloying and slag-forming additions to the melt, decarburizing the melt by injecting a gas mixture comprising oxygen and a dilution gas into the melt through said tuyere(s); following decarburization, injecting sparging gas into the melt through said tuyere(s), said tuyere(s) being gas cooled during at least a portion of the production process, characterized by the steps comprising, in combination:

(1) providing a substantially dry refining vessel into which the melt is charged, (2) providing substantially dry cooling gas to the tuyere(s), (3) substantially completing all of the slag-forming additions to the melt prior to the start of decarburization, (4) fluxing the slag forming additions prior to the start of decarburization, (5) substantially completing the addition of all those elements to the melt which are reducable by silicon prior to the start of decarburization, (6) decarburizing the melt to essentially its aim carbon content by injecting into the melt through said tuyere(s), a gas mixture of oxygen and a dilution gas for a time sufficient to remove at least 0.2 weight percent carbon from the melt and maintaining an off-gas flow rate during said decarburization sufficient to substantially prevent air from infiltrating into said vessel, and (7) maintaining the off-gas flow rate during any reduction and finishing steps at a rate sufficient to substantially prevent air from infiltrating into said vessel by injecting sparging gas into the melt through said tuyere(s) in an amount at least equal to 100 cubic feet per ton of melt.

2. The process of claim 1 wherein said slag-forming addition is lime.

3. The process of claim 1 wherein said dilution gas is nitrogen.

4. The process of claim 1 wherein said dilution gas is argon.

5. The process of claim 1 wherein said sparging gas is nitrogen.

6. The process of claim 1 wherein said sparging gas is argon.

7. The process of claim 1 wherein said sparging gas is injected into the melt in an amount at least equal to 150 cubic feet per ton of melt.

8. The process of claim 1 wherein said gas mixture is injected into the melt so as to remove at least 0.3 of carbon.

9. The process of claim 1 wherein the refining vessel is made dry by heating the vessel to a temperature of at least 1500° F.

10. The process of claim 1 wherein the cooling gas contains less than 100 ppm by weight of water.

* * * * *